US007452430B2

(12) United States Patent
Manabe et al.

(10) Patent No.: US 7,452,430 B2
(45) Date of Patent: Nov. 18, 2008

(54) METHOD FOR REFORMING A1 ALLOY CASTINGS

(75) Inventors: Yasuo Manabe, Takasago (JP); Makoto Yoneda, Takasago (JP); Shigeo Kofune, Takasago (JP)

(73) Assignee: Kabushiki Kaisha Kobe Seiko Sho (Kobe Steel, Ltd.), Kobe-shi (JP)

( * ) Notice: Subject to any disclaimer, the term of this patent is extended or adjusted under 35 U.S.C. 154(b) by 349 days.

(21) Appl. No.: 10/675,970

(22) Filed: Oct. 2, 2003

(65) Prior Publication Data

US 2004/0221932 A1 Nov. 11, 2004

(30) Foreign Application Priority Data

Oct. 10, 2002 (JP) ..... 2002-297227

(51) Int. Cl.
*C22C 1/04* (2006.01)

(52) U.S. Cl. ..... 148/694; 148/698; 419/49

(58) Field of Classification Search ..... 148/694, 148/698; 419/49

See application file for complete search history.

(56) References Cited

U.S. PATENT DOCUMENTS 4,582,681 A 4/1986 Asari et al.
6,146,477 A * 11/2000 Clark et al. ..... 148/539
6,524,409 B2 2/2003 Barone et al.
2001/0023722 A1 9/2001 Barone et al.

FOREIGN PATENT DOCUMENTS

JP 58-71301 4/1983
JP 61-47901 10/1986
JP 11-57965 3/1999
JP 2001158951 A * 6/2001
JP 2001-262295 9/2001

OTHER PUBLICATIONS

"ASM Handbook: vol. 7 Powder Metal Technologies and Applications", ASM International, 1998, pp. 608-609.*
S. Gallo, et al., Metallurgical Science and Technology, vol. 19, No. 1, "Reasons to Develop Liquid Hot Isostatic Pressing", Jun. 2001.
E. Romano, et al., Metallurgical Science and Technology, vol. 19, No. 1, "The Effect of Liquid Hot Isostatic Pressing on Fatigue Properties of Al Based Castings", Jun. 2001.

* cited by examiner

*Primary Examiner*—Roy King
*Assistant Examiner*—Janelle Morillo
(74) *Attorney, Agent, or Firm*—Oblon, Spivak, McClelland, Maier & Neustadt, P.C.

(57) ABSTRACT

In reforming mechanical characteristics of a precipitation hardening type Al alloy casting, the Al alloy casting is subjected to a high temperature/high pressure treatment, then the pressure is reduced while maintaining the temperature of the Al alloy casting, and subsequently the Al alloy casting is subjected to solution treatment, quenching, and aging in this order. According to this method, mechanical characteristics of the casting can be reformed efficiently and economically and there can be obtained a reformed product of good quality.

3 Claims, 6 Drawing Sheets

METHOD FOR REFORMING A1 ALLOY CASTINGS

BACKGROUND OF THE INVENTION

1. Field of the Invention

The present invention relates to a method for reforming Al alloy castings, especially a method for reforming mechanical characteristics of precipitation hardening type Al alloy castings by heating and pressing the Al alloy castings. More particularly, the present invention is concerned with an improved method comprising an appropriate combination of a reforming method using the pressure of a high temperature, high pressure gas (hereinafter referred to as "HIP method"), with heat treatment under atmospheric pressure (solution treatment, quenching, and aging) and which can thereby reform mechanical characteristics of castings efficiently and economically.

2. Description of the Related Art

There is known an HIP method wherein after casting Al alloy, the Al alloy casting is treated in a high temperature, high pressure gas atmosphere to crush pore defects. In the case of an Al alloy which requires heat treatment for ensuring a required strength, HIP treatment is usually followed by re-heating and subsequent solution treatment, water quenching, and aging to ensure a strength characteristic of a target level.

For example, FIG. 1 illustrates known temperature and pressure operation conditions in case of adopting the HIP method. General HIP conditions in case of treating Al alloy castings involve a temperature of 500° to 530° C., a pressure of about 100 MPa, and a treatment time of about 1 to 3 hours. In this case, the time required after loading the workpiece into an HIP apparatus until taking out the workpiece from the apparatus involves the time taken for evacuation and gas purging in the HIP apparatus after the loading of the workpiece and the time taken for heating and pressing and for reducing the temperature and pressure before and after maintaining predetermined high temperature and high pressure, thus requiring an extra time of about 4 hours relative to the actual high temperature/high pressure holding time. As a whole, the required time is about 6 to 8 hours.

In the conventional equipment, a heat treatment apparatus and an HIP apparatus are often located away from each other, so the workpiece after HIP treatment is once allowed to stand in air, then conveyed up to the place where the heat treatment apparatus is installed, and are thereafter re-heated. As shown in FIG. 1, the heat treatment performed after HIP treatment is usually "T6 treatment" which comprises three steps of solution treatment (6 to 10 hours)→water quenching→aging (8 to 12 hours), requiring a total of 21 to 30 hours.

In subjecting an alloy casting which requires such a heat treatment and HIP treatment, the HIP treatment temperature is usually almost equal to or a little lower than the solution treatment temperature, so if it is possible to carry out solution treatment concurrently with HIP treatment, it is considered possible to not only simplify the treatment process but also shorten the required time. Studies have long been made on this regard. Actually, however, due to various problems resulting from the use of a high pressure gas, the technique for carrying out solution treatment concurrently with HIP treatment has not been practically applied yet.

According to another conventional technique, solution treatment is performed concurrently with HIP treatment while changing temperature and pressure as in FIG. 2 (Metallurgical Science and Technology, Vol. 19, No. 1, June 2001, FIG. 6-b). However, due to a problem in operation, temperature is also dropped rapidly at the same time as reduction of pressure after the end of HIP treatment.

SUMMARY OF THE INVENTION

The present invention has been accomplished in view of the above-mentioned circumstances and it is an object of the invention to provide a reforming method capable of solving three problems involved in this type of technique, i.e., problems related to productivity (short-time treatment), treatment cost, and energy saving, and capable of solving the problems described above.

The gist of the Al alloy casting reforming method according to the present invention which could solve the foregoing problems resides in that, in reforming mechanical characteristics of an Al alloy casting by subjecting the Al alloy casting to the action of temperature and pressure, a high temperature/high pressure treatment (HIP treatment) is applied to the Al alloy casting, then the pressure is reduced while holding the temperature of the workpiece, and subsequently solution treatment, quenching, and aging are carried out in this order.

In carrying out the method of the present invention, it is recommended to adopt, as an efficient method, a method comprising preheating a workpiece to a temperature near HIP treatment temperature prior to HIP treatment, then pressing the workpiece and holding it for a predetermined time, thereafter reducing the pressure of the workpiece while holding its temperature, and subsequently performing solution treatment, quenching, and aging in this order. In this case, the preheating prior to the high temperature/high pressure treatment may be done in the interior of a heat insulating structure which is used in the high temperature/high pressure treatment.

In the present invention there may be adopted a method wherein a heat insulating structure is provided, the Al alloy casting is accommodated in the interior of the heat insulating structure, and then the high temperature/high pressure treatment and the solution treatment are applied to the Al alloy casting accommodated within the heat insulating structure. Alternatively, the Al alloy casting may be covered with a heat-resistant porous heat insulator and then the high temperature/high pressure treatment and the solution treatment may be performed for the Al alloy casting thus covered with the heat-resistant porous heat insulator. By so doing, it is possible to enhance the thermal efficiency.

According to the present invention constructed as above, HIP treatment for Al casting can be done extremely efficiently in combination with so-called T6 treatment (solution treatment+quenching+aging), and in comparison with the conventional method wherein HIP treatment is followed by re-heating and subsequent solution treatment, it becomes unnecessary to carry out solution treatment by re-heating and hence the productivity can be greatly improved.

DETAILED DESCRIPTION OF THE PREFERRED EMBODIMENTS

Embodiments of the present invention will be described in detail hereinunder with reference to the accompanying drawings.

Figure 3:
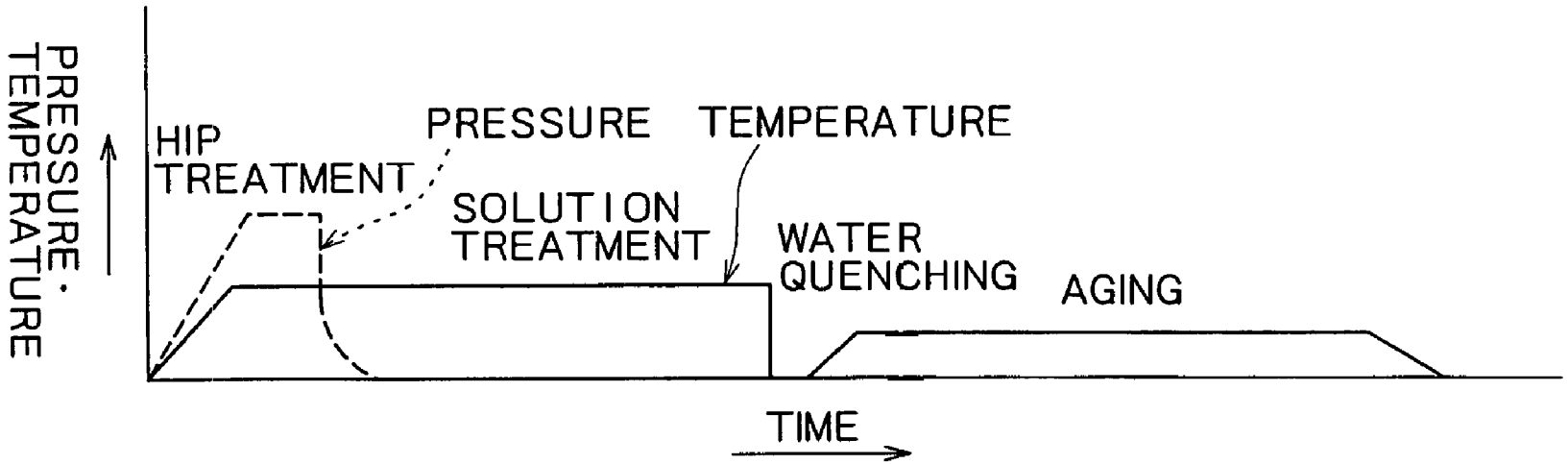
FIG. 3 illustrates a typical treatment method comprising HIP treatment→solution treatment→aging which method is adopted to reform castings in the present invention.

FIG. 3 is an explanatory process diagram showing a typical embodiment of the present invention. In the same figure, it is preferable to control the temperature so that the temperature itself of a workpiece (Al casting) becomes the illustrated temperature. But actually operation is performed on the basis of the intra-furnace temperature.

The mode for carrying out the illustrated treatment method is broadly classified into two. In one method, a conventional HIP apparatus, is used for HIP treatment and existing solution treatment apparatus, water quenching apparatus and aging furnace are used for heat treatment. Another method uses a dedicated systematized equipment which permits continuous execution of both HIP treatment and heat treatment. Each of the methods will be described below.

First, a description will be given of the method which uses a conventional HIP apparatus.

In performing a reforming treatment with use of an apparatus of this type, a workpiece is loaded into the HIP apparatus while being covered with a material (hereinafter referred to as "heat-resistant porous insulator" ) having heat resistance and high in both porosity and heat insulating property, such as ceramic fiber. Then, the interior of the HIP apparatus is evacuated and is purged with a non-oxidizing gas (e.g., nitrogen or argon), then is raised in both temperature and pressure up to HIP treatment conditions. Also as a pressure medium gas for increasing the pressure there may be used nitrogen or argon. Such a heat medium gas of a high pressure is high in density and low in viscosity, giving rise to a vigorous heat convection, therefore the thermal efficiency is high as compared with heating under atmospheric pressure and the temperature of a workpiece can be raised to a predetermined temperature rapidly in a short time. Particularly, in a high pressure gas atmosphere, the convection of the high pressure gas is not so suppressed even in the covered state of the workpiece with the heat-resistant porous heat insulator as described above, so that there is little influence on heating-up the workpiece. Thus, if heating is conducted under pressurization with gas or under a high gas pressure, even the internal temperature of the workpiece can be increased up to a temperature almost equal to the atmospheric temperature by heating in a short time. The final temperature and pressure holding conditions for HIP treatment somewhat differ depending on the type of Al alloy casting, but a general temperature is 500° to 540° C. which is almost equal to the solution treatment temperature and a general pressure is about 50 to 200 MPa.

As to the pressure holding time, if the purpose of pressing is for only true densification by crushing pores and shrinkage cavities present in the interior of the workpiece, a time of 10 to 30 minutes suffices provided the internal temperature of the workpiece reaches the aforesaid temperature. But the pressing also has the effect of increasing the solid solution quantity of the alloy elements in addition of the above purpose, and in order for this effect to be also exhibited effectively it is recommended that an appropriate temperature and pressure condition be held for 1 to 3 hours.

More particularly, in the case of Al—Si alloy, the maximum solid solution quantity of Si at a eutectic point (578° C.) is only about 1.5 atom % under atmospheric pressure, but increases to about 1.9 atom % in 100 MPa and about 2.4 atom % at 200 MPa. Thus, the diffusion of precipitated Si to the base phase is promoted remarkably under the application of pressure and therefore the solution treatment time can be greatly shortened in comparison with that in solution treatment under atmospheric pressure. For example, even in the case where the solid solution time of about 8 hours considered necessary under atmospheric pressure, it can be shortened to about 2 to 3 hours under the application of pressure, in order to ensure almost the same effect.

After holding at predetermined temperature and pressure for a predetermined time, high pressure gas is extracted and released from the interior of the HIP apparatus while maintaining the said temperature. At this time, the internal temperature of the apparatus drops with expansion of the gas, though depending also on the pressure releasing speed, so during pressure release, it is preferable to maintain the predetermined temperature by heating with use of a heating means such as a heater provided in the HIP apparatus. After pressure release to the atmospheric pressure, the workpiece covered with the heat-resistant porous heat insulator is taken out from the HIP apparatus and is conveyed to a solution treatment furnace.

In the prior art, as pointed out earlier, a temperature drop of workpiece during conveyance in the air at room temperature poses a serious problem. However, if the workpiece is covered with a heat-resistant porous heat insulator as described above, then under atmospheric pressure the drop of temperature is suppressed by the effect of the heat insulator covering the workpiece. But it goes without saying that it is preferable to minimize the workpiece conveyance time. The subsequent heat treatment is carried out in accordance with the usual procedure using a conventional heat treatment furnace for example.

The solution treatment temperature is about the same as the HIP treatment temperature in most cases, and even in case of covering the workpiece with a heat-resistant porous heat insulator as referred to previously, there does not occur such a temperature variation as poses any problem. After setting the holding time at high temperature and high pressure to, for example, 2 to 3 hours and terminating the solution treatment at a high pressure, the pressure is released while holding this temperature, immediately followed by water quenching. In water quenching, in order to ensure a rapid cooling effect, there is made a drop of temperature from a solution treatment temperature of about 500° to 540° C. to preferably a temperature of 150° to 200° C. at a rate of around 100° C./min, more preferably around 1000° C./min or not higher than 1000° C./min.

The steps up to the water quenching step is carried out in a covered state of the workpiece with the heat-resistant porous heat insulator. However, after the temperature of the workpiece is once dropped by water quenching, it is no longer necessary to continue the covering for heat insulation, so at this stage the heat-resistant heat porous heat insulator is removed and aging is performed. The aging may be done in accordance with a conventional method, which is usually carried out at a temperature of 150° to 200° C. for 20 to 4 hours.

Figure 4:
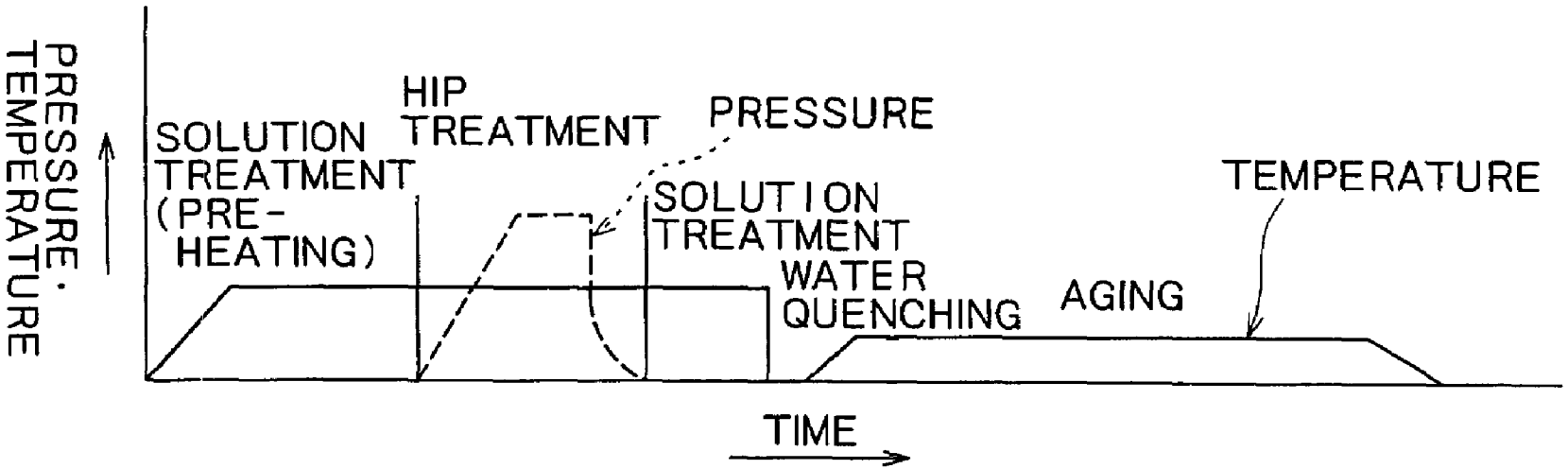
FIG. 4 illustrates another treatment method comprising solution treatment (+HIP treatment)→aging which method is adopted to reform castings in the present invention.

In FIG. 3 there is shown a case where HIP treatment is conducted, serving also as solution treatment, at an initial stage of heat treatment. In the example shown in the same figure, after the HIP treatment, solution treatment is conducted for a short time if necessary, followed by water quenching and aging. In FIG. 4 there is shown an example in which, for solution treatment, a workpiece is preheated to a temperature near the solution treatment temperature, thereafter the pressure is raised and HIP treatment is conducted, further, solution treatment is performed for a short time if necessary, followed by water quenching and aging.

If this method is adopted, since HIP treatment is allowed to serve also as solution treatment, eventually solution treatment is allowed to proceed under a high pressure condition, so that it becomes possible to greatly shorten the total treatment time.

Next, reference will be made below to the use of a systematized, dedicated equipment which permits a continuous execution of both HIP treatment and heat treatment. This equipment is, for example, such an equipment as shown in FIGS. 5 and 6.

This equipment is designed exclusively for Al alloy castings and the HIP apparatus body used is also designed as a dedicated apparatus, so the time required for increasing and decreasing temperature and pressure and for releasing pressure before and after the usual high temperature/high pressure holding time for HIP treatment is considered to be a total of about 1 to 2 hours. That is, if the high temperature/high pressure holding time if 1 hour, the total required time for HIP treatment (occupancy time of the HIP apparatus) including the temperature/pressure raising and pressure releasing time before and after the high temperature/high pressure holding is 2 to 3 hours.

Figure 5:
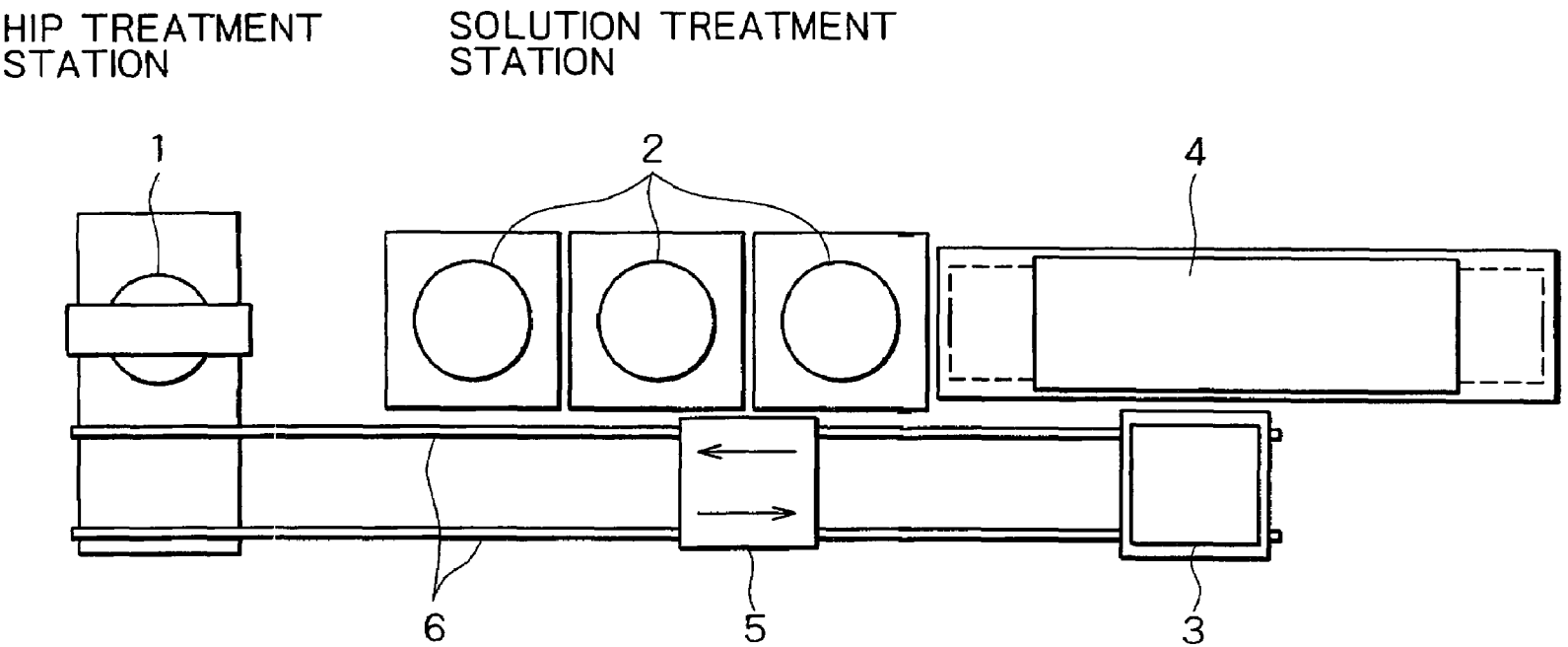
FIG. 5 is a schematic explanatory diagram showing a specific example of a series of treatment stations for HIP treatment to aging which stations are used in practicing the present invention.
Figure 6:
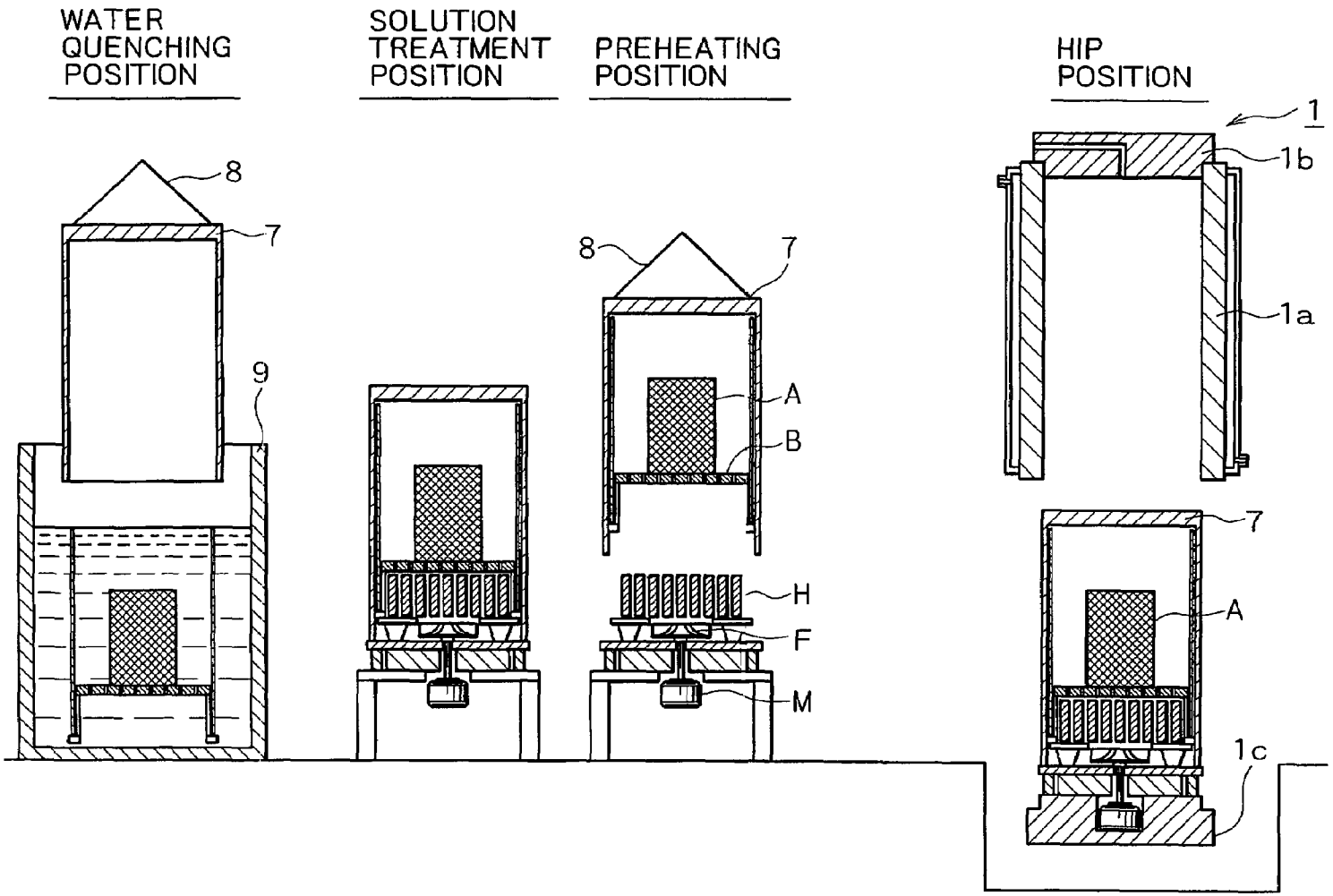
FIG. 6 is a schematic sectional explanatory diagram illustrating a dedicated treating equipment comprising a combination of an HIP apparatus and a water quenching water tank which equipment is adopted preferably in practicing the present invention.

FIG. 5 shows a layout example of the equipment, in which the numeral 1 denotes an HIP apparatus body, numeral 2 denotes a heater for solution treatment, 3 a water tank for water quenching, 4 a tunnel type aging furnace, 5 a carrier, 6 a conveyance rail. In case of using a single HIP apparatus as shown in the figure, the time required for solution treatment and aging treatment is long relative to the time required for HIP treatment, so for carrying out a series of treatments efficiently it is preferable to use plural (three in the illustrated example) heaters 2 for solution treatment, as shown in the figure.

Since water quenching can be carried out in a short time, only one water tank 3 for water quenching suffices. The aging furnace 4 may be of a batch by batch treatment type. However, since aging is performed after water quenching, the workpiece temperature is near room temperature and hence handling of the workpiece is easy. Besides, since the aging temperature is as relatively low as 150° to 200° C., the use of a tunnel type furnace as the aging furnace 4, into which a workpiece is loaded basket by basket containing the workpiece as will be described later, is advantageous to the reduction of equipment cost and of occupied space.

As shown for example in FIG. 5 to be referred to later, a workpiece is covered preferably with a heat-resistant porous heat insulator and is loaded in this state into a heat insulating vessel, then after HIP treatment in the HIP apparatus 1, the workpiece is conveyed on the carrier 5 to the heaters 2 for solution treatment, in which solution treatment is performed. Then, the workpiece is conveyed on the carrier 5 to above the water tank 3 for water quenching and is dipped into the water tank 3, allowing water quenching to proceed. Thereafter, the workpiece is drawn out from the water tank 3 and is conveyed in a successive manner to the tunnel type aging furnace 4 for aging treatment.

In actual treatment there are used an HIP apparatus with an electric furnace incorporated therein, the electric furnace having such a heat insulating structure 7 as illustrated in FIG. 6 for example, as well as a solution treatment furnace (also used in preheating to be described later). More specifically, the illustrated HIP apparatus 1 is constituted as an integral combination of a high pressure cylinder 1*a* having a cooling water jacket, a upper HIP vessel lid 1*b*, and a lower HIP vessel lid 1*c*. In the lower HIP vessel lid 1*c* is provided a forced convection type heating unit constituted by an integral combination of a heater H, a fan F, and a fan driving motor M. Of course, there is no reason for limiting a specific construction of the HIP apparatus 1 to the illustrated one. HIP apparatuses of various other shapes and structures than the illustrated one are also employable insofar as they have a function of maintaining the interior of the furnace in a heated and pressurized state to predetermined temperature and pressure. The numeral 8 in the figure denotes a suspending wire.

In performing HIP treatment, a workpiece A is placed in a gas- and liquid-permeable basket B constituted by, for example, a porous metal plate or a metal net in a covered state with a heat-resistant heat insulator as described above, then the basket is placed into the heat insulating structure 7, thereafter the high pressure cylinder 1*a* and the upper and HIP vessel lids 1*b*, 1*c* are closely fitted on the heat insulating structure 7, followed by the application of heat and pressure to effect HIP treatment. By thus placing the workpiece A within the heat insulating structure 7 during HIP treatment and solution treatment, it is possible to efficiently increase the temperature for heating and minimize the drop of temperature during conveyance in the air. This is preferable.

In order that the radiation of heat induced by natural convection in a high pressure gas atmosphere can be suppressed effectively, the heat insulating structure 7 is preferably constituted by two to three layers of metal cups and a ceramic heat insulator. Under atmospheric pressure the heat insulating structure 7 exhibits a still higher heat insulating property. Therefore, after HIP treatment, even if the workpiece A is drawn out from the HIP apparatus and is conveyed in the air while being accommodated in the heat insulating structure 7, there scarcely occurs any drop of temperature caused by heat radiation in the course of conveyance. The workpiece A can be conveyed to the next solution treatment step without temperature drop.

As shown in the figure, after the end of a predetermined solution treatment at a solution treatment position, the workpiece A is conveyed to above a water tank 9 in its accommodated state within the heat insulating structure 7 and is dipped, together with the basket B (any other receptacle means will also do, of course), into the water tank 9 and is water-quenched. During this period, the drop in temperature of the workpiece A during the conveyance thereof is kept as low as possible because it temperature is retained by the heat insulating structure 9. It is preferable that the time required from taking the workpiece A out of the solution treatment position to water quenching in the air be set within 15 seconds in order to further suppress the drop of its temperature.

If there is carried out the foregoing "method comprising preheating a workpiece to a temperature near HIP treatment temperature prior to HIP treatment, then pressing the workpiece and holding it for a predetermined time, thereafter reducing the pressure of the workpiece while holding its temperature, and subsequently performing solution treatment, quenching, and aging in this order" and thus if HIP treatment is performed for the purpose of only true densification by the removal of pores, it becomes possible to shorten the holding time in HIP treatment to about 10 to 15 minutes.

That is, the holding step in the conventional HIP treatment includes a step of causing a phenomenon to proceed in which the internal temperature of a workpiece is raised up to an intra-furnace atmospheric temperature and crushing pores by the pressure of gas and also causing a phenomenon to proceed in which, after the crushing, inner surfaces of the original pores are diffusion-bonded to each other and a precipitate is diffused for homogenization. An industrially applied holding time is usually 1 to 3 hours, but the greater part thereof is spent as the time for the former, i.e., for raising the temperature of the workpiece A up to the intra-furnace atmospheric temperature. Therefore, the holding time can be shortened if the temperature is raised to a sufficient degree in the preheating operation prior to HIP treatment.

On other hand, as to the adherence of pore defects and the diffusion of precipitate, a holding time of about 10 to 15 minutes can afford satisfactory adherence and diffusion in most cases though depending on the size of pore defects and that of precipitates.

In conclusion, the pressure holding time in HIP treatment can be shortened to the degree mentioned above. FIG. 4 referred to above illustrates an operation process with respect to temperature and pressure in case of performing such a preheating operation. By performing the preheating operation, the HIP treatment alone can be completed in 1 to 2 hours. If the number of the solution treatment furnace and that of the aging furnace are selected so as to match the HIP treatment time, and more preferably, at least as to the aging furnace, if there is used such a tunnel type continuous aging furnace as illustrated in the drawing, it is possible to effect both HIP treatment and heat treatment with a cycle of 1 to 2 hours. Besides, a reformed casting free of pore defects, superior in mechanical characteristics and high in reliability can be produced in high yield and productivity.

Making the most of the above characteristics, the method of the present invention is effectively applicable to reforming of various Al alloy castings such as Al—Si, Al—Si—Mg, Al—Mg, and Al—Cu—Mg. Above all, if the method of the invention is applied to a sand mold-cast, precipitation hardening Al alloy casting of a relatively large size with a weight of 5 kg or more, since the Al alloy casting contains large crystal grains and porous defects and precipitate are also large, the method is applicable as a technique for not only eliminating porous defects but also finely dispersing the precipitate to effect reforming and the feature of the present invention can thereby be utilized more effectively.

EXAMPLE

The present invention will be described below more specifically by way of working examples. It is to be understood that the invention is not limited by the following working examples and that changes may be made in the scope conforming to the above and the following gist of the invention and all of those changes are included in the technical scope of the invention.

Using JIS AC4CH alloy (A1-7% Si-0.35% Mg), boat-like test pieces (a trapezoidal section, 40 mm and 20 mm in base, 40 mm in height, and about 200 mm in length) were sand mold-cast and were subjected to reforming in accordance with the prior art and the present invention, then were evaluated for mechanical characteristics, productivity, and heating power consumption. Basic treatment temperatures, etc. were set as follows: HIP treatment 520° C.×100 MPa, solution treatment 530° C., water quenching 60° C. (water temperature), aging temperature 170° C.

Comparative Example 1

Figure 1:
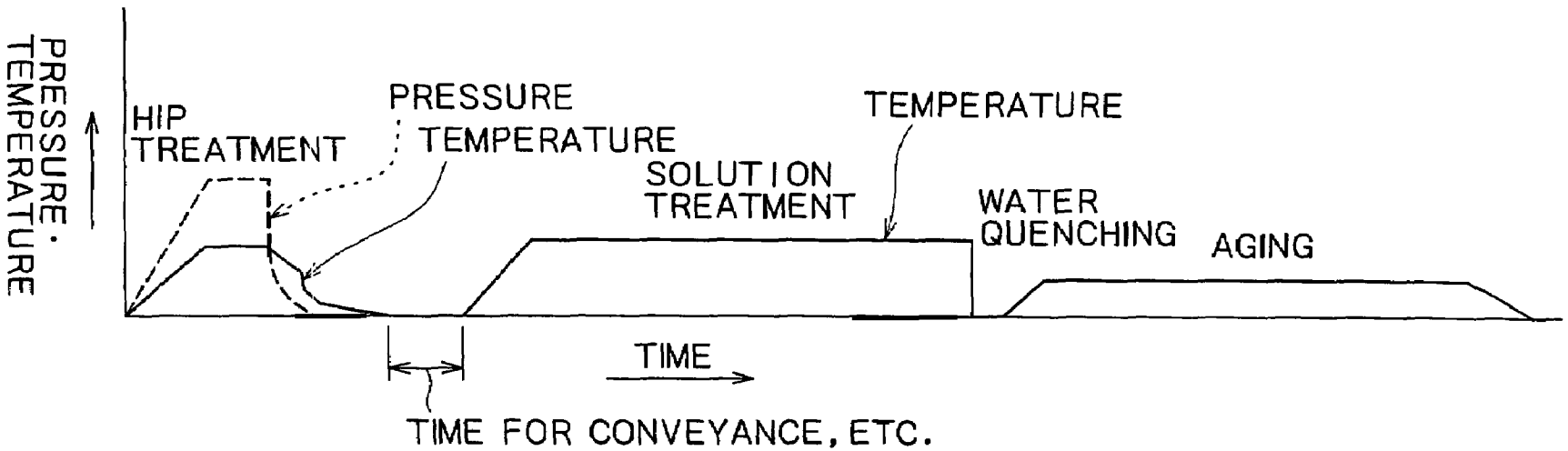
FIG. 1 illustrates a treatment method comprising a series of such treatments as HIP treatment→solution treatment→aging which method has heretofore been adopted to reform castings.
Figure 2:
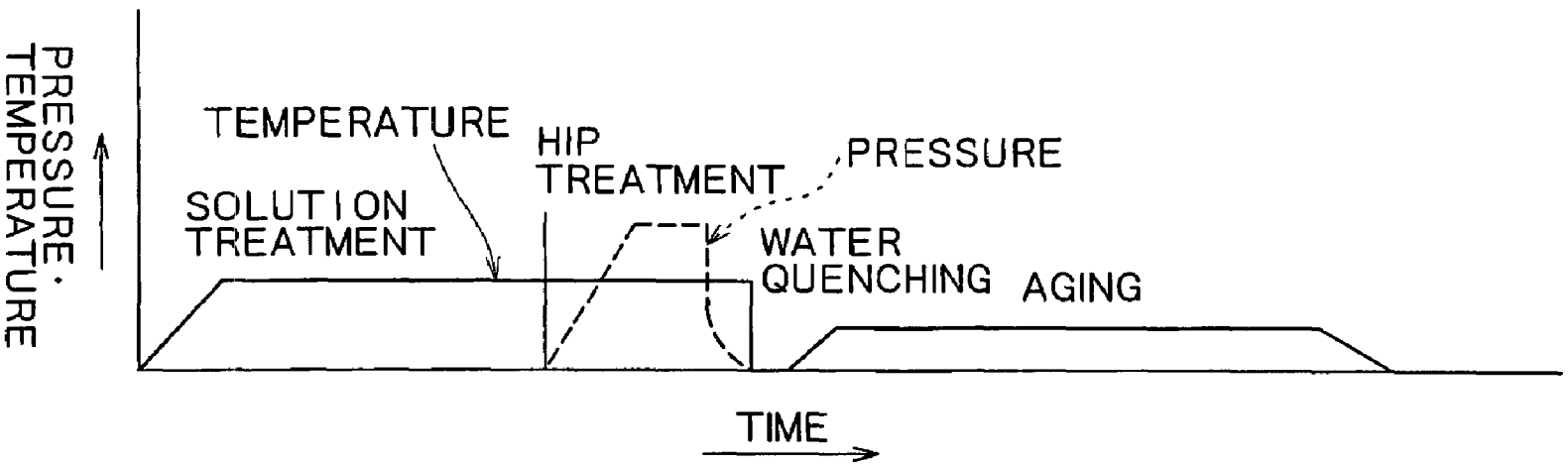
FIG. 2 illustrates another treatment method which has heretofore been adopted to reform castings.

Treatments were carried out in accordance with the temperature/pressure operation conditions shown in FIG. 1. For HIP treatment there was used a large-sized HIP apparatus using a molybdenum heater and having maximum reachable temperature and pressure of 1400° C. and 150 MPa. A workpiece was loaded into the HIP apparatus, then the interior of the HIP apparatus was evacuated and purged with gas over a period of about 1 hour. Thereafter, temperature and pressure were raised at a time. The compressor performance required 2 hours and 30 minutes for raising pressure up to 100 MPa. After the temperature and pressure had been held at 515° C. and 100 MPa, respectively, for 2 hours, the heating power was cut off, the workpiece was allowed to cool naturally to 250° C. and the pressure was released while recovering gas. The temperature of the workpiece after the pressure release dropped to about 50° C. due to the adiabatic expansion of the gas caused by the release of pressure. In this state the workpiece was taken out. The time taken from the loading of the workpiece until discharge of the treated workpiece was 8 hours.

The workpiece was conveyed to a factory having heat treatment equipment, then was accommodated within a basket for heat treatment and was loaded into a solution treatment furnace, in which solution treatment was conducted for 8 hours, followed by water quenching. Subsequently, the workpiece was allowed to stand at room temperature for 3 hours, then was loaded into an aging furnace and was aged for 10 hours. The time required for a series of these heat treatments (T6 treatment) was 22 hours and the time required from HIP treatment until the end of heat treatment was a little over 30 hours even exclusive of the time required for conveyance from HIP treatment to the heat treatment equipment.

A mechanical characteristic of the workpiece was checked by fatigue strength measurement in a rotating bending fatigue test to find that the fatigue strength in $10^7$ cycle was about 118 MPa.

The electric power consumed for heating in the above treatments was a total of about 450 kwh, made up as follows: 150 kwh in the HIP apparatus, 200 kwh in the solution treatment furnace, and 100 kwh in the aging furnace.

Example 1

A reforming treatment was conducted in accordance with the temperature and pressure conditions shown in FIG. 3. A workpiece was subjected to the reforming treatment in a covered state with a 3 mm thick blanket formed of a mullite ceramic fiber. For HIP treatment there was used an HIP apparatus using an Fe—Al alloy heater and capable of being opened at a high temperature, the HIP apparatus having a maximum reachable temperature of 1200° C. and a maximum reachable pressure of 100 MPa.

The workpiece covered with the blanket was loaded into the HIP apparatus and then interior of the apparatus was evacuated and purged with gas over a 30 minute period, then the temperature and pressure were raised to 520° C. and 100 MPa simultaneously over a period of about 2 hours and the workpiece was held in this condition for 2 hours. Thereafter, the pressure was released while raising the temperature to 530° C. and while recovering gas, whereby the pressure was reduced to the atmospheric pressure over a period of about 45 minutes. The HIP apparatus was opened while maintaining the temperature at 530° C., then the workpiece covered with the blanket was taken out into the atmosphere and was conveyed to a solution treatment position. The occupancy time in the HIP apparatus was about 5 hours and 30 minutes.

In a solution treatment furnace the workpiece was held at 530° C. for 5 hours, then was taken out in the state covered with the blanket into the atmosphere and, within 30 seconds, was dipped into a water tank for water quenching held at 60° C. Thereafter, the workpiece was taken out from the water tank and the ceramic fiber blanket cover was removed, then the workpiece was allowed to stand at room temperature for 3 hours and was subsequently loaded into an aging furnace, in which aging was performed for 10 hours. The time required from HIP treatment until the end of heat treatment was 24 hours and thus it was possible to attain a 6 hours' (about 20%) shortening of time as compared with Comparative Example 1.

The reformed product thus obtained was subjected to a fatigue test in the same way as in Comparative Example 1 and proved to have about the same fatigue strength in $10^7$ cycle as in the comparative example.

The electric power required for heating in the above treatments was a total of 375 kwh, made up as follows: 150 kwh in the HIP apparatus, 125 kwh in the solution treatment furnace, 100 kwh in the aging furnace. Thus, there was attained an energy saving effect of about 75 kwh (about 17%) as compared with Comparative Example 1.

Example 2

Using the same equipment as in Example 1, a reforming treatment was conducted, in which the holding condition in HIP treatment was set at 530° C.×100 MPa and the holding time was set at 3 hours. Thereafter, the pressure was released while maintaining the temperature at 530° C. and then the workpiece was water-quenched, followed by aging in the same way as in Example 1 and subsequent evaluation for fatigue strength. The time required from HIP treatment until the end of heat treatment was about 19 hours and 30 minutes, which is about two thirds of that in Comparative Example 1. The result of fatigue strength evaluation made in the same manner as in Comparative Example 1 was 120 MPa in $10^7$ cycle and thus was higher than that obtained in the comparative example. The electric power consumed for heating was a total of 300 kwh, made up as follows: 200 kwh in the HIP apparatus and 100 kwh in the aging furnace. Thus, there was attained an energy saving of 150 kwh (about 33%) in comparison with Comparative Example 1.

Example 3

A reforming treatment was carried out using the HIP apparatus and the water tank for water quenching of the structures shown in FIGS. 5 and 6 and under the temperature and pressure conditions shown in FIG. 4.

A workpiece was placed in an uncovered state into a basket fabricated using a stainless steel wire and then the basket with the workpiece therein was accommodated into the heat insulating structure in the HIP apparatus, then the temperature was raised up to 530° C. over a 2 hour period using a dedicated heater for preheating, followed by holding at this temperature for 3 hours. While the interior of the heat insulating structure was held at 530° C., the heat insulating structure was put on the lower lid of the HIP apparatus and the workpiece was thus loaded into the HIP apparatus. After subsequent nitrogen gas purge over a period of about 15 minutes, the pressure was raised to 100 MPa over a 30 minute period with use of a compressor and the interior of the apparatus was held at 530° C. for 1 hour. Thereafter, the pressure was released to the atmospheric pressure while maintaining the temperature at 530° C. and while recovering gas. Then, the heat insulating structure was again conveyed to the heater for preheating while maintaining the internal temperature thereof at 530° C., followed by holding in this state for 3 hours.

Subsequently, the heat insulating structure with the workpiece contained therein was conveyed to above the water tank for water quenching and both workpiece and basket were moved down into water (40° C.) to effect water quenching. Thereafter, the workpiece was taken out into the atmosphere and was allowed to stand at room temperature for 3 hours for drying, then the workpiece was loaded into the aging furnace and was aged in the same manner as in Example 1. The time required from the start of preheating until the end of heat treatment was about 23 hours and thus there could be attained a shortening of time of about 7 hours in comparison with Comparative Example 1. The fatigue strength characteristic of the treated product obtained was about the same as in Comparative Example 1.

Because of a small quantity of heat radiated from heat insulating structure in the HIP apparatus, the electric power required for heating was a total of 272 kwh, made up as follows: 100 kwh in the HIP apparatus, 72 kwh in the preheating and solution treatment apparatus, and 100 kwh in aging treatment. Thus, there could be attained an energy saving of 178 kwh (about 40%) as compared with Comparative Example 1. The occupancy time of the high-pressure vessel in the HIP apparatus is about 2 hours and 30 minutes and thus it turned out that by using plural heat insulating structures, the productivity of HIP treated product could be increased to at least three times as high as that in Comparative Example 1. Further, if the holding time is shortened to about 15 minutes, the occupancy time of the HIP apparatus which is high in cost can be shortened to 1 hour or so and thus it is apparent that the cost of the HIP treatment portion can also be reduced to a great extent.

What is claimed is:

1. A method for reforming mechanical characteristics of an Al alloy casting by subjecting the Al alloy casting to the action of temperature and pressure, said method comprising the steps of:

introducing the Al alloy casting into an HIP apparatus capable of withstanding HIP pressure therein, subjecting said Al alloy casting to a high temperature/high pressure HIP treatment in the HIP apparatus, reducing the pressure in the HIP apparatus while maintaining the temperature of the thus-treated Al alloy casting in the HIP apparatus at about the same temperature as the temperature of the high temperature/high pressure treatment, and subsequently carrying out solution treatment, quenching, and aging in this order, wherein a heat insulating structure is provided, said Al alloy casting is accommodated in the interior of said heat insulating structure and is then introduced in the HIP apparatus and subjected in this state to said high temperature/high pressure HIP treatment and said solution treatment.

2. The method of claim 1, wherein, prior to said high temperature/high pressure HIP treatment, the Al alloy casting is preheated to a temperature near said high temperature and then said high temperature/high pressure treatment is performed in the HIP apparatus under the application of pressure.

3. A method for reforming mechanical characteristics of an Al alloy casting by subjecting the Al alloy casting to the action of temperature and pressure, said method comprising the steps of:

introducing the Al alloy casting into an HIP apparatus capable of withstanding HIP pressure therein, subjecting said Al alloy casting to a high temperature/high pressure HIP treatment in the HIP apparatus, reducing the pressure in the HIP apparatus while maintaining the temperature of the thus-treated Al alloy casting in the HIP apparatus at about the same temperature as the temperature of the high temperature/high pressure treatment, and subsequently carrying out solution treatment, quenching, and aging in this order, wherein said Al alloy casting is covered with a heat-resistant porous heat insulator and is then introduced in the HIP apparatus and subjected in this state to said high temperature/high pressure HIP treatment and said solution treatment.

* * * * *